US005632409A

United States Patent [19]

Raghunanan

[11] Patent Number: 5,632,409

[45] Date of Patent: May 27, 1997

[54] PLASTIC BAG HOLDER

[76] Inventor: Cheryl J. Raghunanan, 658 W. Front St., Plainfield, N.J. 07060

[21] Appl. No.: 546,415

[22] Filed: Oct. 20, 1995

[51] Int. Cl.[6] ..... A47K 10/24

[52] U.S. Cl. ..... 221/45; 312/71

[58] Field of Search ..... 221/33, 45, 61, 221/63, 155, 312 R, 282, 303; 312/183, 190, 71

[56] References Cited

U.S. PATENT DOCUMENTS 4,913,312 4/1990 Boutin ..... 221/45

5,042,687 8/1991 McKinley ..... 221/45

*Primary Examiner*—Kenneth Noland

[57] ABSTRACT

A plastic bag holder is disclosed. The plastic bag holder comprises a housing formed of a front wall and a parallel back wall with parallel side walls therebetween. Each of the walls has upper edges and lower edges and with side edges therebetween. A rectangular bottom wall with side edges is coupled to the lower edges of the front and rear and side walls with an open top thereabove. All the walls are formed of a rigid material but with a slot in the front wall and an aperture in the bottom wall. The side walls have outwardly extending projections. A lid is formed with a top wall and linear front and rear and side edges and with trapezoidal side walls extending downwardly at an angle therefrom. The lid has a rectangular shoulder on its interior surface located at an intermediate extent of its side walls and with downwardly extending gripping fingers adjacent to the lower edges thereof. The lid is formed of a material with limited resilience. The fingers are selectively positionable over the outwardly extending projections of the housing. The lid also has a handle on the upper surface of its top wall.

4 Claims, 3 Drawing Sheets

PLASTIC BAG HOLDER

BACKGROUND OF THE INVENTION

1. Field of the Invention

The present invention relates to a new and improved plastic bag holder and, more particularly, pertains to supporting a quantity of flexible plastic bags and to dispense them in a most convenient manner.

2. Description of the Prior Art

The use of containers for receiving and supporting a wide variety of objects is known in the prior art. More specifically, containers for receiving and supporting a wide variety of objects heretofore devised and utilized for the purpose of supporting and dispensing articles through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for supporting a quantity of flexible plastic bags and to dispense them in a most convenient manner. By way of example, U.S. Pat. No. 3,888,442 to Comeux discloses a garbage bag support and storage device.

U.S. Pat. No. 4,574,981 to Jewett discloses an apparatus for dispensing cans and the like.

U.S. Pat. No. 4,623,073 to Hansen discloses a dispenser for cards.

U.S. Pat. No. 4,785,971 to Konarik discloses a bag storage and dispensing apparatus.

U.S. Pat. No. 4,787,522 to Nocek et al. discloses a bag storage device.

Lastly, U.S. Pat. No. 5,042,687 to McKinley discloses a shopping bag dispenser.

In this respect, the plastic bag holder according to the present invention substantially departs from the conventional concepts and designs of the prior art, and in doing so provides an apparatus primarily developed for the purpose of supporting a quantity of flexible plastic bags and to dispense them in a most convenient manner.

Therefore, it can be appreciated that there exists a continuing need for a new and improved plastic bag holder which can be used for supporting a quantity of flexible plastic bags and to dispense them in a most convenient manner. In this regard, the present invention substantially fulfills this need.

SUMMARY OF THE INVENTION

In view of the foregoing disadvantages inherent in the known types of containers for receiving and supporting a wide variety of objects now present in the prior art, the present invention provides an improved plastic bag holder. As such, the general purpose of the present invention, which will be described subsequently in greater detail, is to provide a new and improved plastic bag holder and methods which has all the advantages of the prior art and none of the disadvantages.

To attain this, the present invention essentially comprises a new and improved plastic bag holder comprising, in combination, a housing formed of a front wall and a parallel back wall with parallel side walls therebetween, each of the walls having upper edges and lower edges and with side edges therebetween, a rectangular bottom wall with side edges coupled to the lower edges of the front and rear and side walls with an open top thereabove, all the walls being formed of a rigid material but with a downwardly extending U-shaped slot in the front wall and a rectangular aperture in the bottom wall, the side walls having outwardly extending projections; a lid formed with a top wall and linear front and rear and side edges and with trapezoidal side walls extending downwardly at an angle therefrom, the lid having a rectangular shoulder on its interior surface located at an intermediate extent of its side walls and with downwardly extending gripping fingers adjacent to the lower edges thereof, the lid being formed of a elastomeric material with limited resilience, the fingers being selectively positionable over the outwardly extending projections of the housing, the lid also having a handle on the upper surface of its top wall; a door formed of an elastomeric material of limited resilience with an associated handle on its lower surface with a hinge secured to one edge of the door coupled to the housing adjacent to its lower edge and positionable in a lower orientation for opening the rectangular aperture in the housing and an elevated closed position for closing the aperture in the housing; and a force-imparting assembly formed of an essentially rigid plate at its upper extent secured at its edges to the lid at its shoulders and having a lower plate positionable at an intermediate extent of the housing with a coil spring therebetween urging the lower plate downwardly to force bags therebeneath in a directions towards the aperture at the bottom of the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved plastic bag holder which has all the advantages of the prior art containers for receiving and supporting a wide variety of objects and none of the disadvantages.

It is another object of the present invention to provide a new and improved plastic bag holder which may be easily and efficiently manufactured and marketed.

It is a further object of the present invention to provide a new and improved plastic bag holder which is of a durable and reliable construction.

An even further object of the present invention is to provide a new and improved plastic bag holder which is susceptible of a low cost of manufacture with regard to both materials and labor, and which accordingly is then susceptible of low prices of sale to the consuming public, thereby making such containers for receiving and supporting a wide variety of objects economically available to the buying public.

Still yet another object of the present invention is to provide a new and improved plastic bag holder which provides in the apparatuses and methods of the prior art some of the advantages thereof, while simultaneously overcoming some of the disadvantages normally associated therewith.

Even still another object of the present invention is to support a quantity of flexible plastic bags and to dispense them in a most convenient manner.

Lastly, it is an object of the present invention to provide a plastic bag holder. The plastic bag holder comprises a housing formed of a front wall and a parallel back wall with parallel side walls therebetween. Each of the walls has upper edges and lower edges and with side edges therebetween. A rectangular bottom wall with side edges is coupled to the lower edges of the front and rear and side walls with an open top thereabove. All the walls are formed of a rigid material but with a slot in the front wall and an aperture in the bottom wall. The side walls have outwardly extending projections. A lid is formed with a top wall and linear front and rear and side edges and with trapezoidal side walls extending downwardly at an angle therefrom. The lid has a rectangular shoulder on its interior surface located at an intermediate extent of its side walls and with downwardly extending gripping fingers adjacent to the lower edges thereof. The lid is formed of a material with limited resilience. The fingers are selectively positionable over the outwardly extending projections of the housing. The lid also has a handle on the upper surface of its top wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
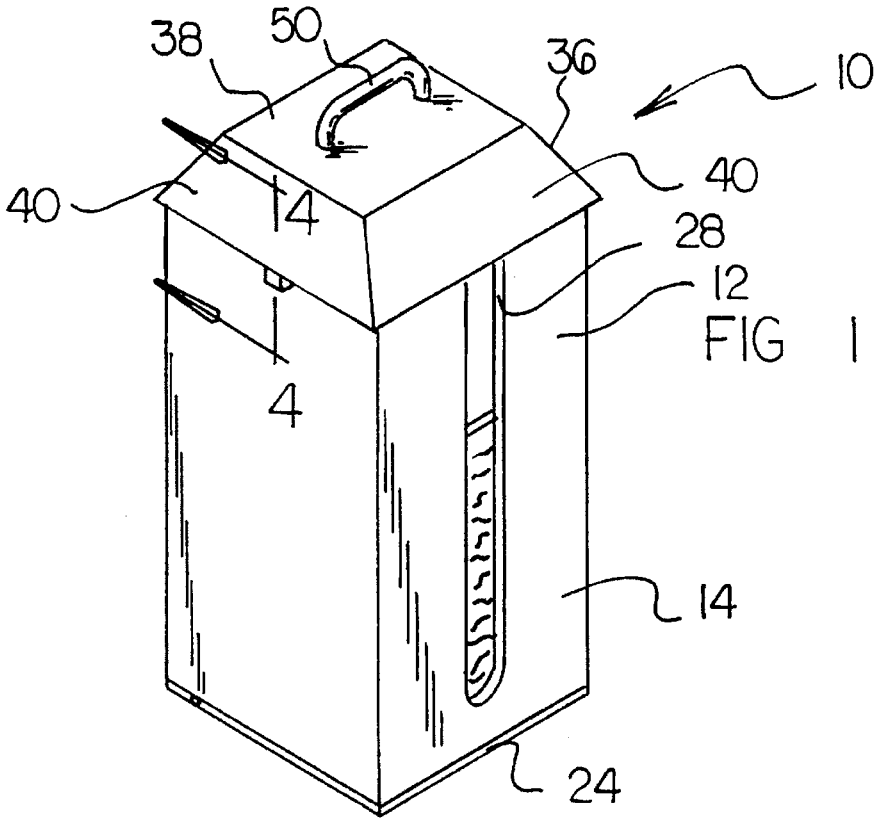
FIG. 1 is a perspective illustration of the preferred embodiment of the new and improved plastic bag holder constructed in accordance with the principles of the present invention.
Figure 2:
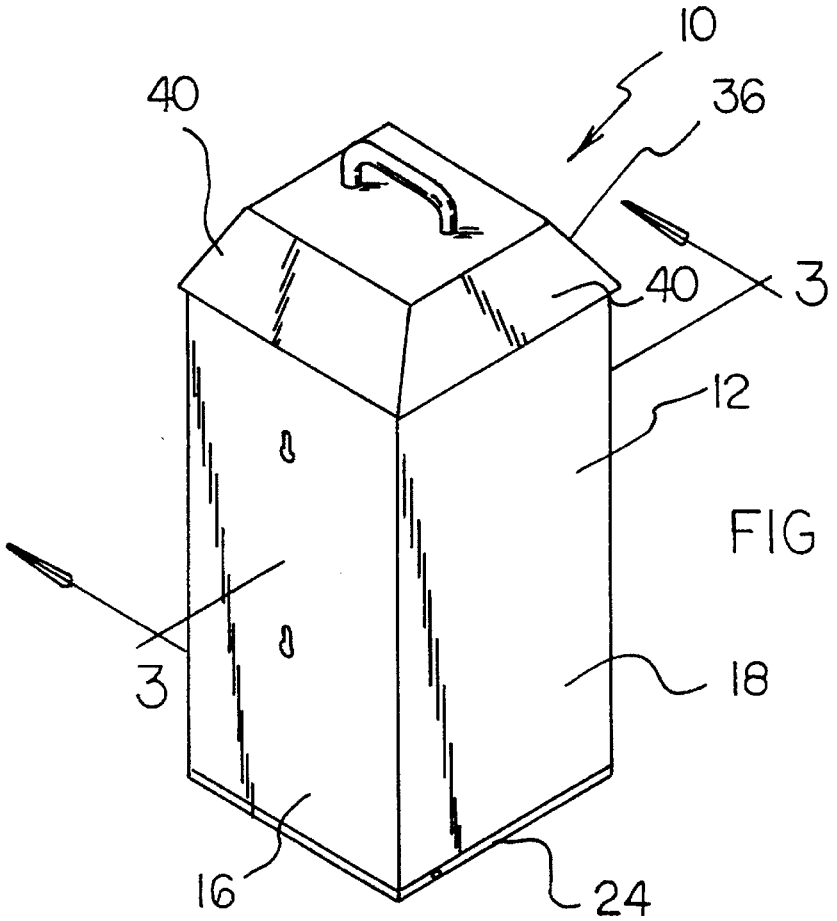
FIG. 2 is a perspective view of the device shown in FIG. 1 but viewed from an opposite side thereof.
Figure 3:
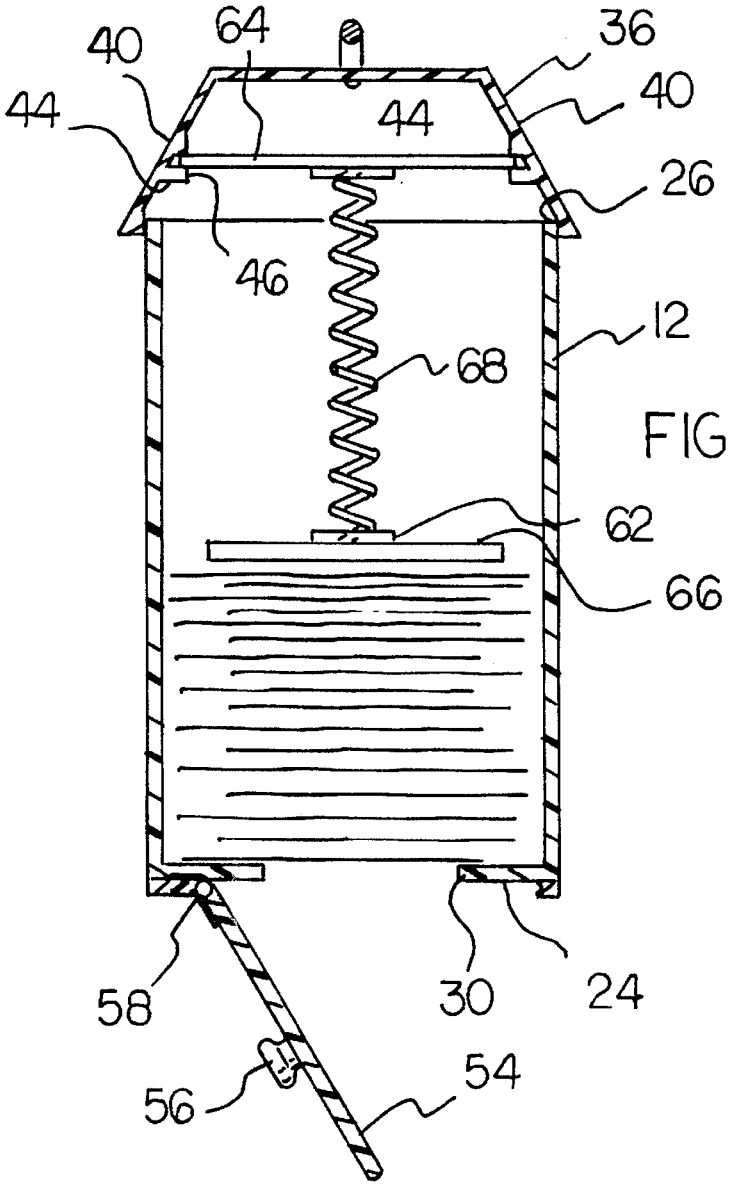
FIG. 3 is a cross-sectional view taken along line 3—3 of FIG. 2.
Figure 4:
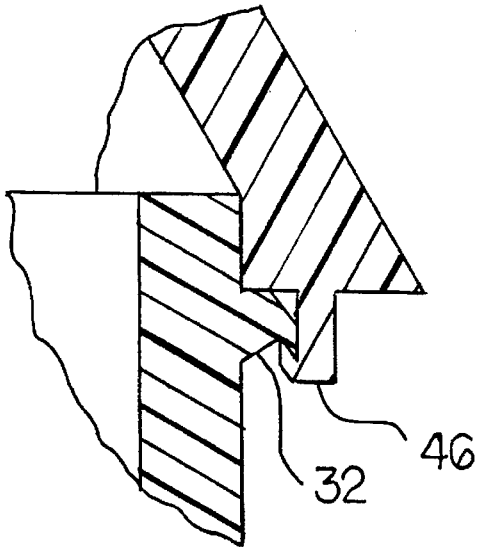
FIG. 4 is an enlarged cross-sectional view taken at the coupling between the housing and the lid.
Figure 5:
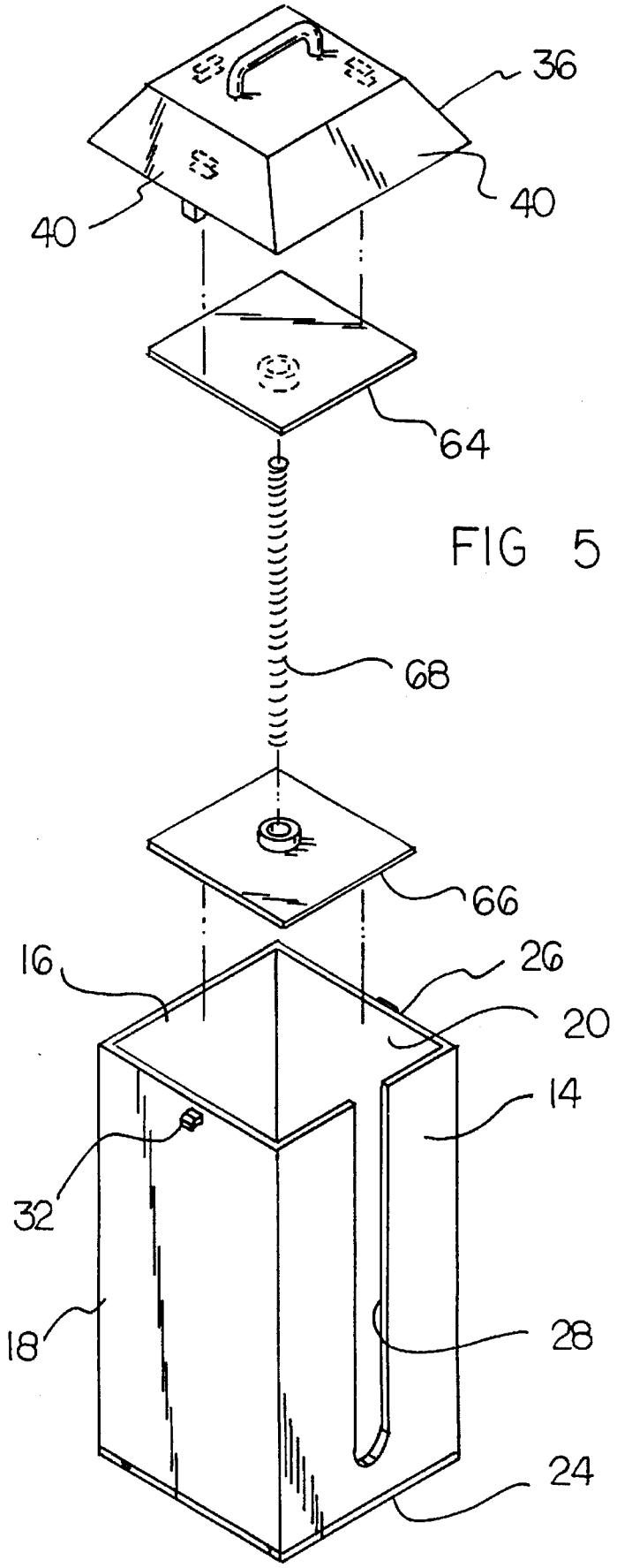
FIG. 5 is an exploded perspective view of the apparatus shown in FIGS. 1, 2 and 3.

With reference now to the drawings, and in particular to FIG. 1 thereof, the preferred embodiment of the new and improved plastic bag holder embodying the principles and concepts of the present invention and generally designated by the reference numeral 10 will be described.

The present invention, the new and improved plastic bag holder is a system 10 comprised of a plurality of components. In their broadest context, the components include a housing, a lid, a door and a force-imparting assembly. Each of the individual components is specifically configured and correlated one with respect to the other so as to attain the desired objectives.

More specifically, the present invention is a system 10 which has as its central component a housing 12. The housing 12 is formed with a front wall 14 and a parallel back wall 16. The housing also has parallel side walls 18,20 therebetween. Each of the walls has upper edges as well as lower edges. Each of the walls also has side edges therebetween.

Next provided as part of the housing is a rectangular bottom wall 24. The bottom wall has side edges coupled to the lower edges of the front and rear and side walls. An open top 26 is thereby formed at the upper edges of the front, rear and side walls. All the walls are preferably fabricated of a rigid material. They are also formed in a rectangular configuration. However, a downwardly extending U-shaped slot 28 is formed in the front wall. In addition, a rectangular aperture 30 is formed in the bottom wall. Additionally, for purposes to be later described, the side walls have outwardly extending projections 32.

The next component of the system 10 is a lid 36. The lid is formed with a top wall 38. It has linear front and rear and side edges. In addition, four trapezoidal side walls 40 extend downwardly at an angle from the edges of the top wall.

The lid is also formed with rectangular shoulders 44 on its interior surface located at an intermediate extent of its side walls. In addition, downwardly extending gripping fingers 46 are located adjacent to the lower edges of the trapezoidal side walls of the lid.

The lid is preferably fabricated of an elastomeric material with limited resilience. In this manner, the fingers are selectively positionable over the outwardly extending projections of the housing. A handle 50 is also formed on the upper surface of the top wall of the lid. In this manner, the lid may be removed by a user to stuff additional plastic bags into the interior of the housing and then the lid is replaced with the fingers interlocked over the projections to form a unitive device for storage, transportation and use other than for filling purposes.

A door 54 constitutes the next major component of the system 10. The door is formed of an elastomeric material of limited resilience. It is formed with an associated handle 56 on its lower surface, preferably at a central extent thereof. The door is also formed with a hinge 58 secured to one end edge of the door, preferably the end edge remote from the U-shaped slot. The edge of the door remote from the hinge is adapted to be moved into and out of frictional contact with the downwardly extending projection on the lower surface of the bottom wall. In this manner, the door may be positionable in a lower orientation for opening the rectangular aperture in the housing so that plastic bags therein may be grasped and pulled for dispensing and use. The door is also movable to an elevated closed position for closing the aperture in the housing during storage and/or transportation.

Lastly provided is a force-imparting assembly 62. Such assembly is formed of an essentially rigid plate 64 at its upper extent. Such rigid plate is secured around its periphery to the lid at its shoulders. The force-imparting assembly also includes a lower plate 66, also preferably of a rigid material. Such plate is positionable at an intermediate extent of the housing as a function of the number of plastic bags located within the housing. In addition, a coil spring 68 is located between the upper and lower plates. The function of the assembly is to force bags therebeneath in a direction towards the aperture of the bottom of the housing to facilitate their dispensing.

The present invention is a storage container for the plastic bags that are given out by grocery stores to carry food. It provides a convenient method of storing and dispensing the reusable items.

The present invention is made of plastic and measures 10 to 12 inches high, 6½ inches wide, and 4½ inches deep. There is a cover with a handle on top of the container for easy removal. The cover has a latch or clasp to enable it to be fastened to the dispenser. A spring-loaded plate is attached to the inside of the lid to push down on the bags and force them toward the bottom of the container. A 1-inch wide opening in the front of the holder enables users to insert bags while the top is removed. There is also a spring-loaded bottom cover that shuts automatically to prevent the bags from falling. Two screws are included for wall mounting.

Bags are loaded into the container through the narrow opening in front, and retrieved from the bottom. The automatic closing feature of the bottom cover helps to ensure that only the desired number of bags comes out.

Currently, people have all sorts of haphazard ways of storing plastic grocery bags, in drawers, empty tissue boxes, cabinets and the like. Some people simply resort to throwing them away, which wastes a perfectly good sack that could be used for garbage. None of these solutions is satisfactory. The present invention described here provides a tidy and convenient storage solution, thereby encouraging re-use of the bags.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved plastic bag holder comprising, in combination:

a housing formed of a front wall and a parallel back wall with parallel side walls therebetween, each of the walls having upper edges and lower edges and with side edges therebetween, a rectangular bottom wall with side edges coupled to the lower edges of the front and rear and side walls with an open top thereabove, all the walls being formed of a rigid material but with a downwardly extending U-shaped slot in the front wall and a rectangular aperture in the bottom wall, the side walls having outwardly extending projections;

a lid formed with a top wall and linear front and rear and side edges and with trapezoidal side walls extending downwardly at an angle therefrom, the lid having a rectangular shoulder on its interior surface located at an intermediate extent of its side walls and with downwardly extending gripping fingers adjacent to the lower edges thereof, the lid being formed of a elastomeric material with limited resilience, the fingers being selectively positionable over the outwardly extending projections of the housing, the lid also having a handle on the upper surface of its top wall;

a door formed of an elastomeric material of limited resilience with an associated handle on its lower surface with a hinge secured to one edge of the door coupled to the housing adjacent to its lower edge and positionable in a lower orientation for opening the rectangular aperture in the housing and an elevated closed position for closing the aperture in the housing; and a force-imparting assembly formed of an essentially rigid plate at its upper extent secured at its edges to the lid at its shoulders and having a lower plate positionable at an intermediate extent of the housing with a coil spring therebetween urging the lower plate downwardly to force bags therebeneath in a directions towards the aperture at the bottom of the housing.

2. A plastic bag holder comprising:

a housing formed of a front wall and a parallel back wall with parallel side walls therebetween, each of the walls having upper edges and lower edges and with side edges therebetween, a rectangular bottom wall with side edges coupled to the lower edges of the front and rear and side walls with an open top thereabove, all the walls being formed of a rigid material but with a slot in the front wall and an aperture in the bottom wall, the side walls having outwardly extending projections; and a lid formed with a top wall and linear front and rear and side edges and with trapezoidal side walls extending downwardly at an angle therefrom, the lid having a rectangular shoulder on its interior surface located at an intermediate extent of its side walls and with downwardly extending gripping fingers adjacent to the lower edges thereof, the lid being formed of a material with limited resilience, the fingers being selectively positionable over the outwardly extending projections of the housing, the lid also having a handle on the upper surface of its top wall.

3. The apparatus as set forth in claim 2 and further including:

a door formed of a material of limited resilience with an associated handle on its lower surface with a hinge secured to one edge of the door coupled to the housing adjacent to its lower edge and positionable in a lower orientation for opening the rectangular aperture in the housing and an elevated closed position for closing the aperture in the housing.

4. The apparatus as set forth in claim 2 and further including:

a force-imparting assembly formed of an essentially rigid plate at its upper extent secured at its edges to the lid at its shoulders and having a lower plate positionable at an intermediate extent of the housing with a coil spring therebetween urging the lower plate downwardly to force bags therebeneath in a directions towards the aperture at the bottom of the housing.

* * * * *